US005349720A

United States Patent [19]

Primeau

[11] Patent Number: 5,349,720

[45] Date of Patent: Sep. 27, 1994

[54] MOP WRINGER

[75] Inventor: Mario Primeau, St. Leonard, Canada

[73] Assignee: Atlantic Promotions Inc., Quebec, Canada

[21] Appl. No.: 191,521

[22] Filed: Feb. 4, 1994

[30] Foreign Application Priority Data

Feb. 4, 1993 [GB] United Kingdom ..... 9302150

[51] Int. Cl.[5] ..... A47C 13/60

[52] U.S. Cl. ..... 15/262; 68/244; 68/257; 100/121

[58] Field of Search ..... 15/262, 260, 261, 263, 15/264, 116.1, 116.2, 119.1, 119.2, 120.1, 120.2; 68/244, 257, 262 R, 263 R; 100/121, 171, 135

[56] References Cited

U.S. PATENT DOCUMENTS 1,392,483 10/1921 Cunningham ..... 15/262
2,023,133 12/1935 Gringer ..... 15/262

FOREIGN PATENT DOCUMENTS 79051 of 1950 Czechoslovakia ..... 15/262
1618383 1/1991 U.S.S.R. ..... 15/262

*Primary Examiner*—David A. Scherbel
*Assistant Examiner*—Gary K. Graham
*Attorney, Agent, or Firm*—Sterne, Kessler, Goldstein & Fox

[57] ABSTRACT

A mop wringer which includes a combination of a pail and lid wherein the lid can be locked to the pail. A first roller is mounted for rotation about a first axis in the lid while the lid includes an opening and a lid panel is hinged to the lid within the opening. The hinged panel rotates about a hinged axis parallel to the first axis and a second roller is mounted to the hinged panel in an area of the hinged panel remote from the second hinged axis and where the second roller is adjacent the first roller and forms a nip therebetween. Spring means extend between the lid and the hinged panel to urge the hinged panel towards a closed position with the first and second rollers adjacent each other, but the hinged panel can be pressed downwardly to provide access through the opening for a mop. When it is required to wring the mop the hinged panel is forced to close the opening while the mop is within the pail such that as the mop is being pulled through the nip formed by the first and second roller the mop strands are wrung.

7 Claims, 6 Drawing Sheets

MOP WRINGER

BACKGROUND OF THE INVENTION

Field of the Invention

The present invention relates to a mop wringer, and in particular, to a mop wringer integrated in the lid of a mop pail.

SUMMARY OF THE INVENTION

It is an aim of the present invention to provide an improved mop wringer construction which will allow the mop wringer to be utilized with greater ease and which will avoid the necessity of applying manual force to the wringer when pulling the mop through.

A construction in accordance with the present invention comprises a mop wringer having a pail and a removable lid adapted to be locked onto the top of the pail to close off the top opening of the pail, the lid having a housing portion, and a first roller is mounted within the housing portion wherein the roller is adapted to rotate on its axis. The lid also includes a cut-out portion and a hinged panel adapted to pivot about an axis spaced apart and parallel to the axis of the first roller. The hinged panel corresponds to the cut-out portion and is adapted to hinge about the hinge axis downwardly into the pail against the tension of a resilient member which is adapted to return the lid to its first position within the plane of the lid. The lid member has a forward edge remote from the hinge axis and parallel to the axis of the first roller. A second roller is mounted in the hinged panel with its axis parallel to the forward edge and the axis of the first roller. When the hinged panel is in its first position, the first and second rollers are spaced apart slightly to form a nip.

In a more specific version of the present invention, the first roller is slidable within the housing away from its first position along a plane parallel to the axis of the first roller in a direction to increase the spacing of the rollers at the nip, and the first roller is urged towards its first position by means of a compression spring.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
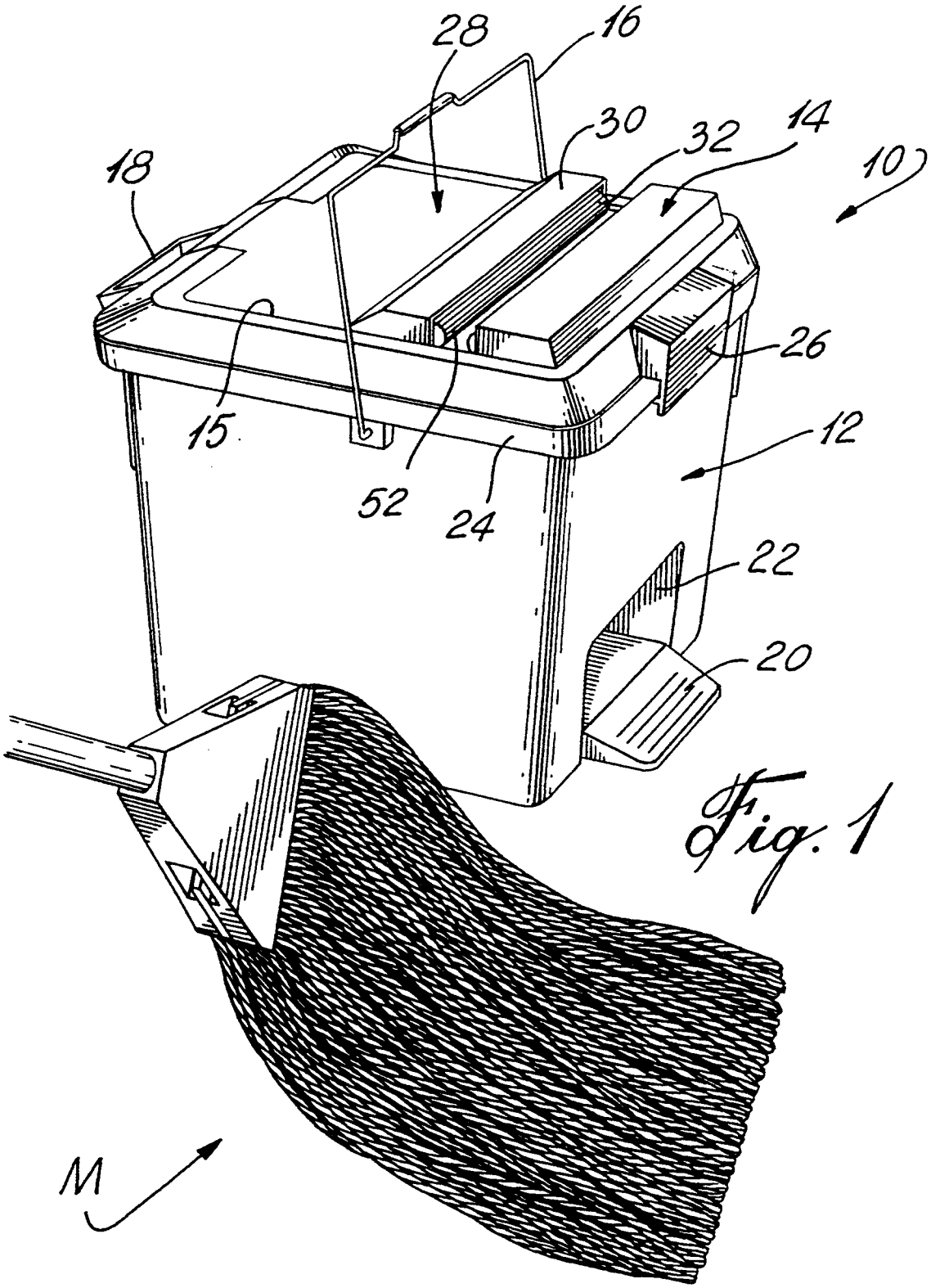
FIG. 1 is a perspective view of a wringer in accordance with the present invention and showing the mop in a position removed from the wringer.

Referring to the drawings and particularly to FIG. 1, there is shown a typical mop M to be used with a wringer 10. The wringer 10 is made up of a pail proper 12 and a lid 14. A handle 16 is connected to the pail as shown. At the rear portion of the pail there is a pour spout 18 while at the lower front wall of the pail, a foot step 20 is set within a recess 22.

The lid 14 includes a flange 24 which overlies a flange 54 of the pail 12. A lock lever 26 is provided on the front end of the lid to engage and lock onto the flange 54.

As shown, the lid 14 includes a cut-out portion 15. A hinged panel 28 pivots about a hinge axis on shaft 42. The lid panel 28 corresponds to the cutout portion 15 and includes at least a pair of arms 40 journaled to the shaft 42, in one embodiment. At least an arm 36 extends downwardly from the lid 14 on one side of cut-out portion 15. A spring 38 extends between the arm 40 and the arm 36. A lid extension 44 projects beyond the hinge axis, remote from the stepped portion 30 of the lid panel 28. A front edge **30*a* is tapered in order to terminate in a relatively sharp edge. This front edge 30*a* serves to engage the strands of the mop when the mop is being removed to close the lid 28 as will be described. Furthermore a hook shaped projection 31 may be provided on lid 28** to facilitate this engagement.

Figure 2:
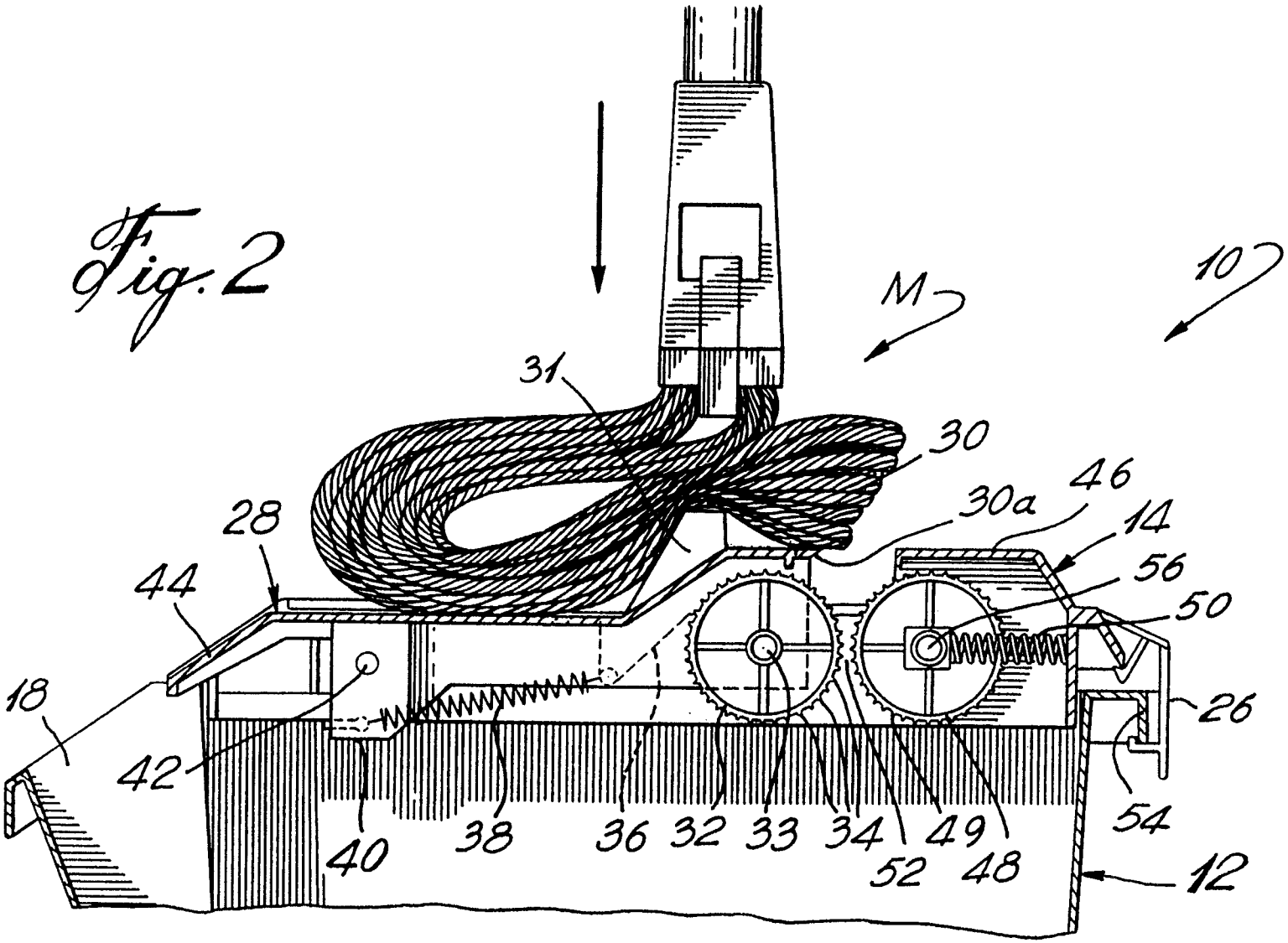
FIG. 2 is a fragmentary vertical cross-section taken longitudinally of the wringer and showing the wringer in a first operative position.

In a rest position the spring 38 retains the hinged lid panel 28 in a first position as shown in FIG. 2. The hinged lid panel 28 mounts a roller 32 having ribs 34. The roller 32 rotates about an axis on a shaft 33 which is parallel to the hinge axis 42. The roller 32 is meant to protrude slightly forwardly of the front edge **30*a* of the stepped portion 30 of the hinged lid panel 28**.

The lid 14 includes a housing 46 in which is mounted a roller 48 having ribs 49. The roller 48 is journaled on a shaft 56 which is adapted to slide in the housing 46 against spring 50. A nip 52 is defined between roller 32 and roller 48.

Figure 3:
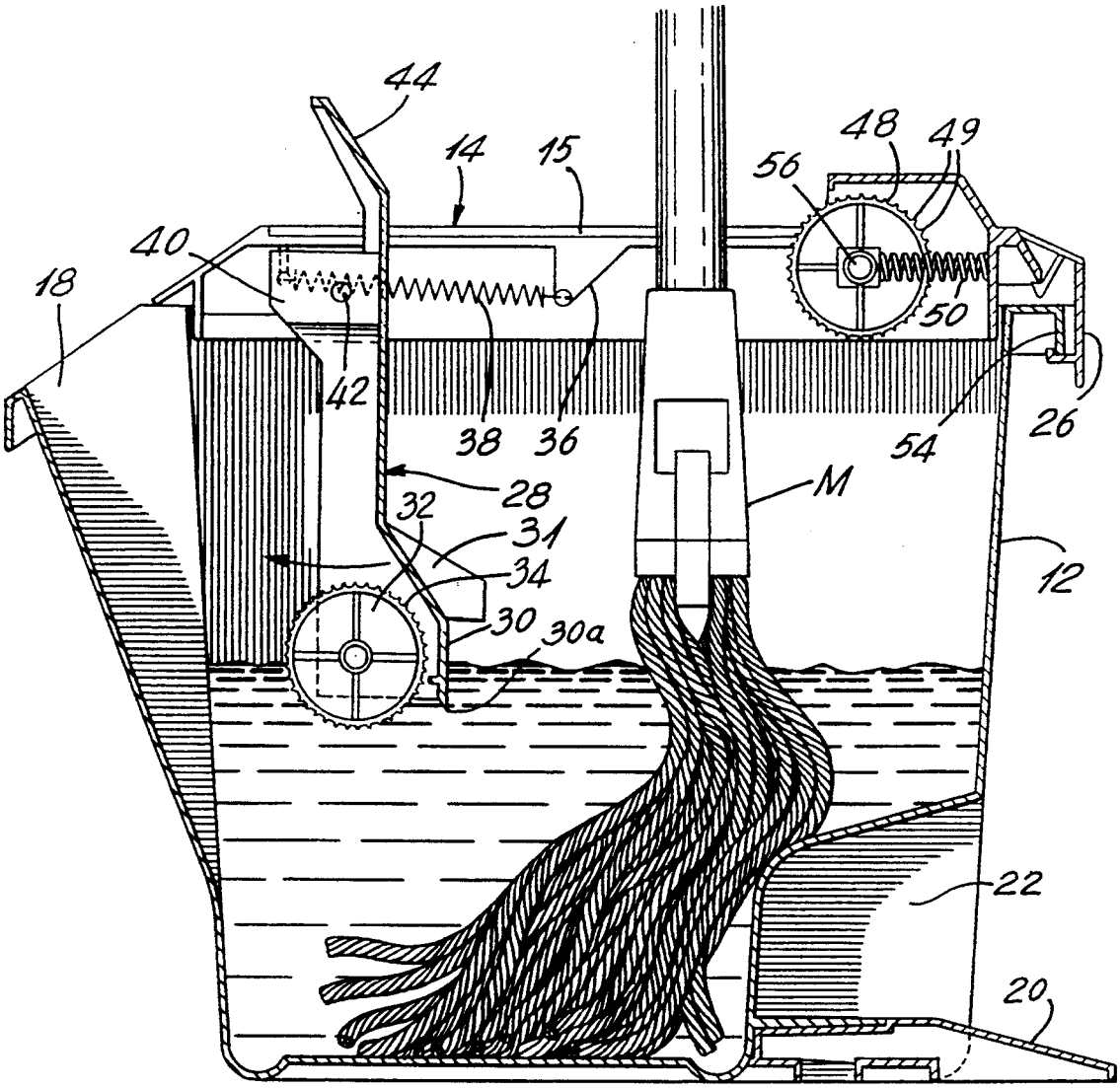
FIG. 3 is a vertical cross-section taken along the longitudinal axis thereof showing the mop immersed in the pail and showing the wringer in a second operative position.

In operation, the mop M, when it is required to be rinsed, is pressed downwardly, as shown in FIG. 2, on the hinged lid panel 28 to cause the hinged lid panel 28 to rotate clockwise about the axis 42. The lid panel 28 can be rotated until the spring 38 is above axis 42, in order that the lid panel 28 be retained in the open position, such as shown in FIG. 3. The mop M is then soaked in a liquid within the pail 12 as shown in FIG. 3.

Figure 4:
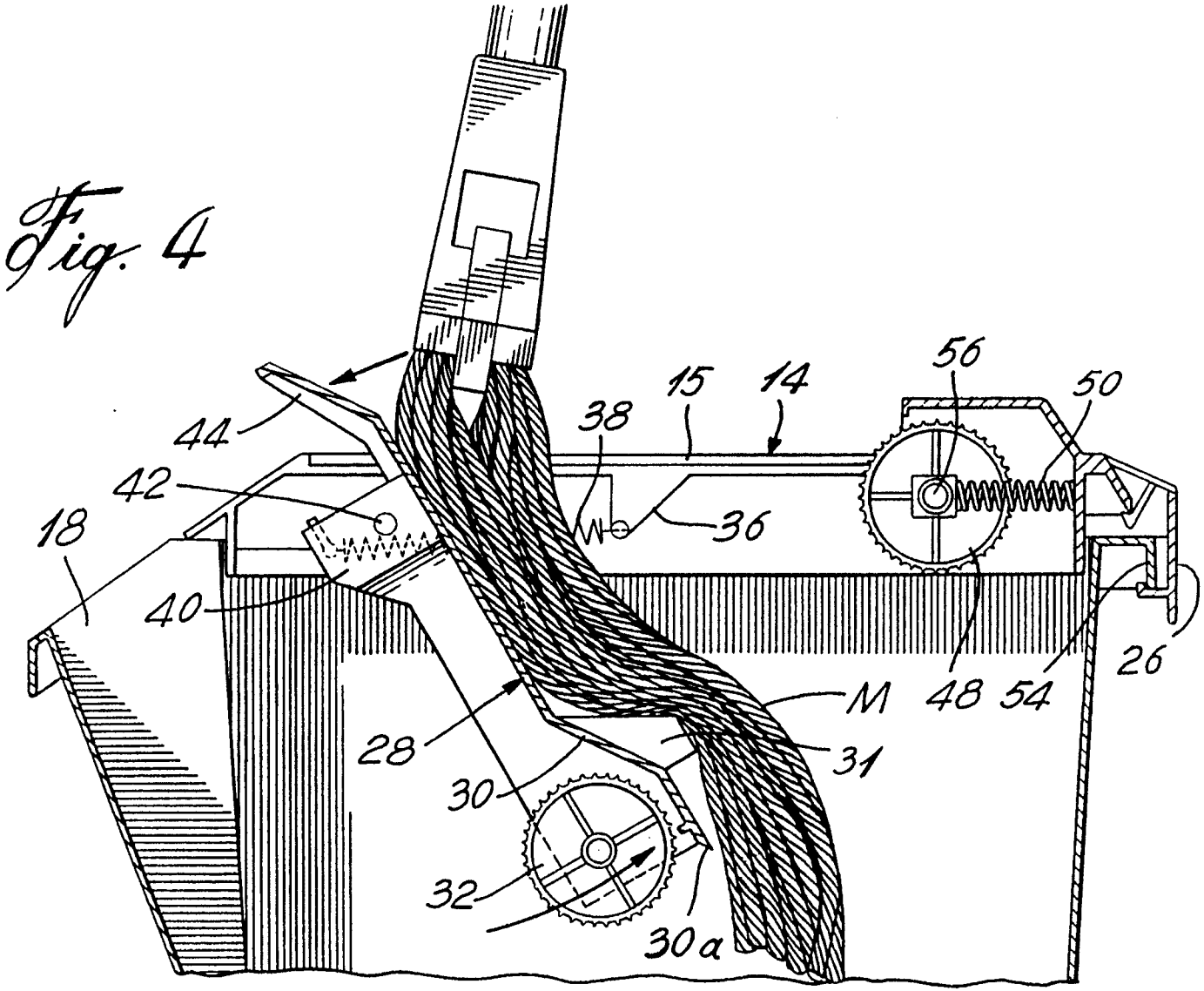
FIG. 4 is a fragmentary vertical cross-section taken along the longitudinal axis of the wringer and showing the wringer in a third operative position.
Figure 5:
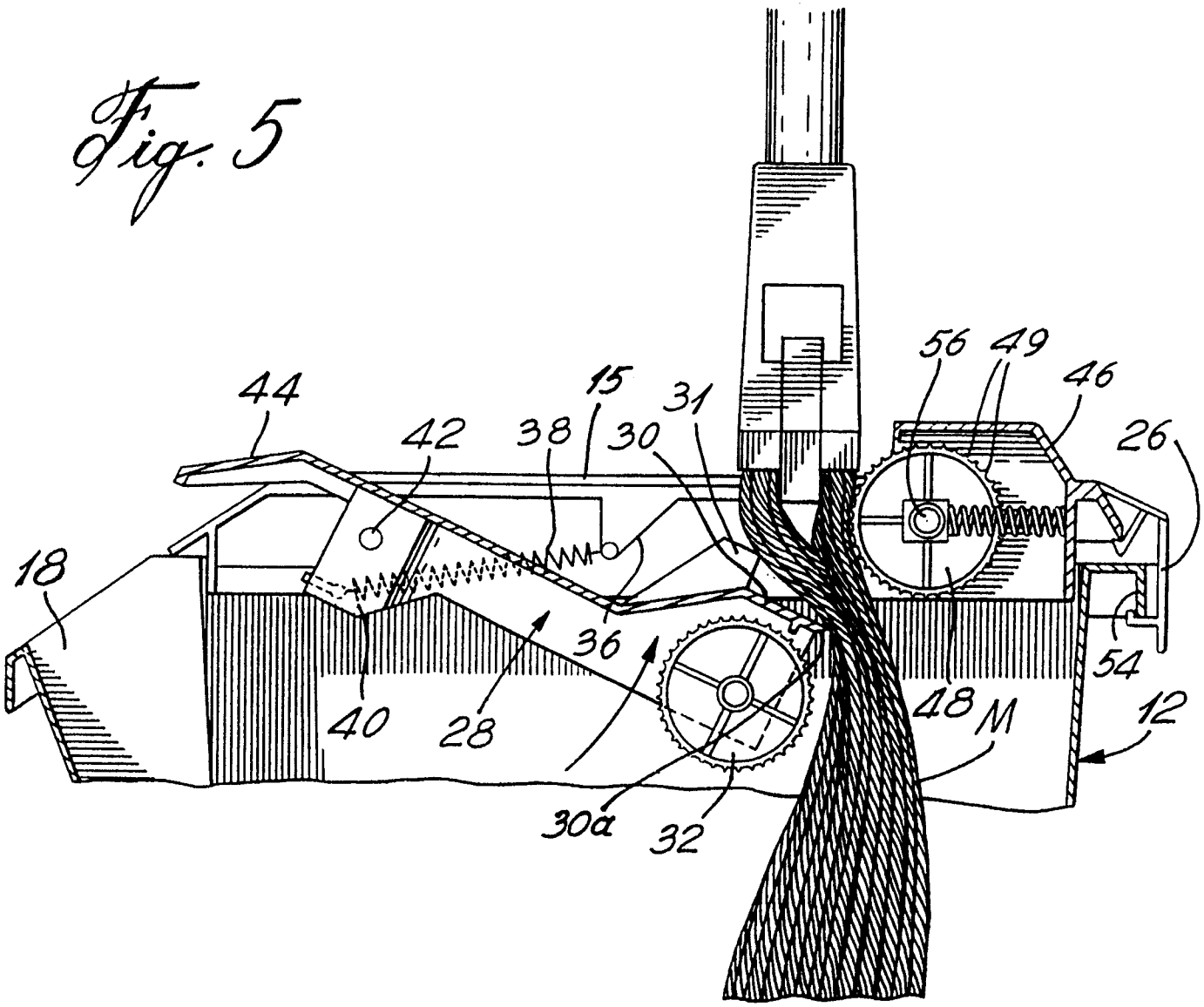
FIG. 5 is a fragmentary vertical cross-section taken along the longitudinal axis thereof and showing the wringer in yet another successive fourth operative position.
Figure 6:
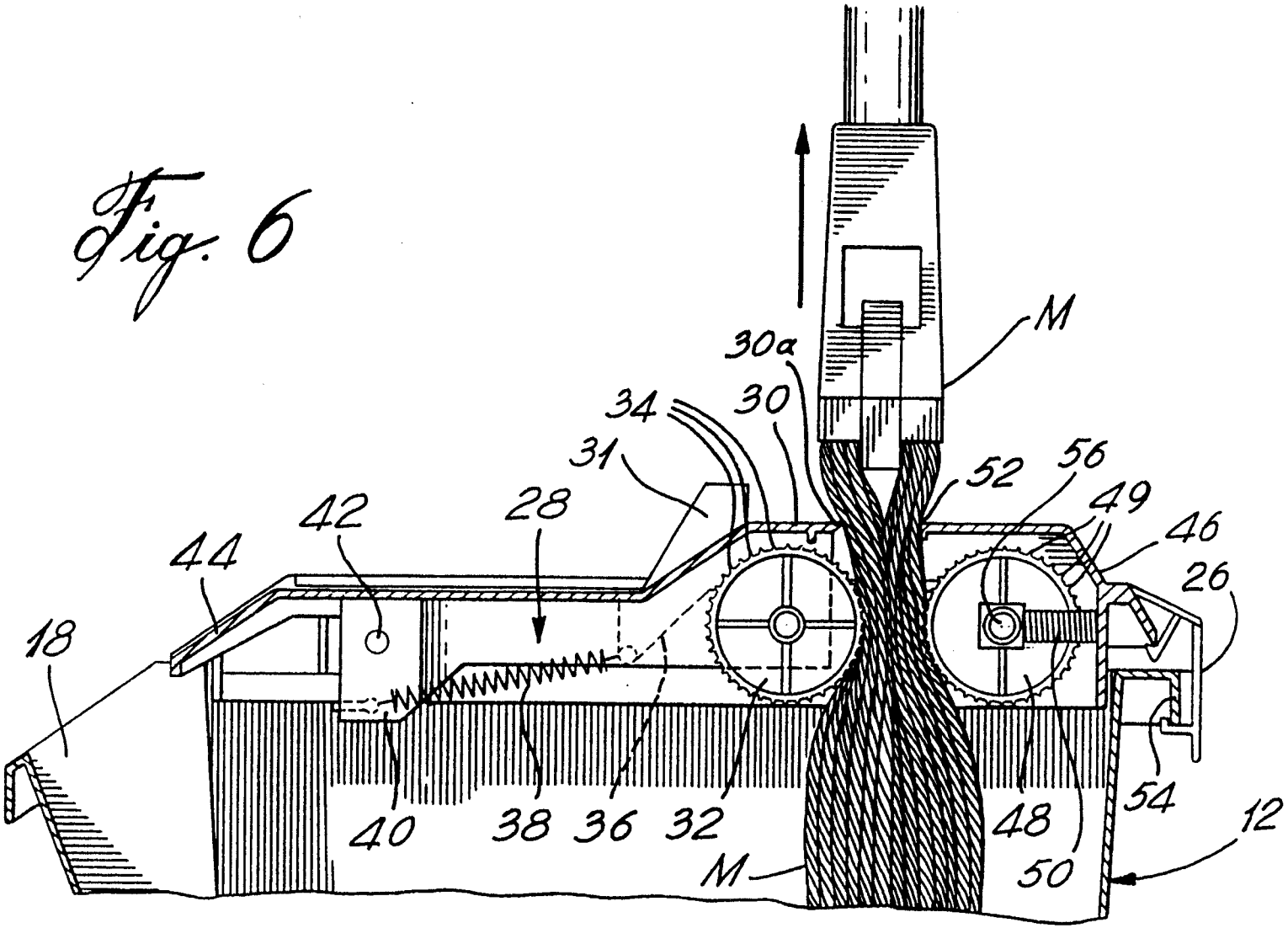
FIG. 6 is a fragmentary vertical cross-section taken along the longitudinal axis of the wringer and showing the wringer in a fifth and final operative position.

When it is required to wring the mop M, the mop M is raised upwardly through the opening 15 in lid 14 as shown in FIG. 4, and by leaning it against the hinged lid panel 28, especially extension 44 so as to get the lid panel 28 to rotate counter clockwise until the spring 38 is below the axis 42 as that the spring can urge the lid panel 28 upwardly. The sharp edge **30*a* will also engage the strands of mop M, and the mop M will draw the hinged panel 28 to rotate counter clockwise towards a position shown in FIG. 5. As the mop M is pulled further upwardly through the nip 52, the hinged lid panel 28 will be returned to its initial and final position as shown in FIG. 6. Thus the mop is forced to pass through the nip 52 between the rollers 32 and 48**.

The operator sets one foot on the foot step 20 to stabilize the wringer during this operation. Depending on the thickness of the mop M, the roller 48 will slide away against the compression spring 50 widening the nip 52. However, the compression spring 50 urges the roller 48 towards the roller 32, and the combination of the rollers 32 and 48 forming a nip 52 causes the water to be squeezed out of the mop as the mop is pulled between the rollers.

I claim:

1. A mop wringer including the combination of a pail and lid, wherein the lid comprises means to lock the lid to the pail, a first roller mounted for rotation about a first axis in the lid, the lid including a cut-out portion and a panel hinged to the lid and provided within the cut-out portion, the hinged panel rotates about a hinge axis parallel to the first axis, a second roller is mounted to the hinged panel in an area of the hinged panel remote from the hinge axis and the axis of rotation of the second roller is parallel to the first axis, the hinged panel including a forward edge parallel to the first axis and near the second roller, spring means extending between the lid and the hinged panel adapted to urge the hinged panel to a first position wherein the second roller is adjacent to and slightly spaced apart from the first roller forming a nip, and to urge the hinge panel to a second position, different from said first position, when the hinged panel is rotated clockwise about the hinge axis wherein the second roller is spaced downwardly within the pail.

2. A wringer as defined in claim 1, wherein the first roller is mounted for sliding movement in a plane passing through the first axis and means for urging the first roller towards the second roller when the hinged panel is in the first position.

3. A wringer as defined in claim 1, wherein the forward edge of the hinged panel is a sharp edge to allow the edge to be engaged by the mop when it is required to pull the mop through the wringer to thereby cause the hinged panel to rotate counter clockwise around its hinged axis.

4. A wringer as defined in claim 1, wherein the spring means extending between the lid and the hinged panel is a coil spring mounted such that when the lid is in its open position, the coil spring is over center of the axis of rotation of the hinged panel so as to retain the panel in the open position while the mop is being conditioned in the pail.

5. A mop wringer as defined in claim 4, wherein the hinged panel includes an extension which goes beyond the axis of rotation and which can act as a lever for initiating the counter clockwise rotation of the hinged panel when it is required to wring the mop through the nip.

6. A wringer as defined in claim 1, wherein the first and second rollers include serrated circumferential surfaces made up of a plurality of longitudinally extending ribs.

7. A wringer as defined in claim 1, wherein the pail is provided with a spout independent of the lid and the pail also includes a lower recessed portion with a foot receiving step to stabilize the pail when the mop is being wrung through the nip.

* * * * *